United States Patent [19]

Ytter

[11] Patent Number: 4,678,246

[45] **Date of Patent: * Jul. 7, 1987**

[54] DISPLAY DEVICE

[75] Inventor: Willy Ytter, Stockholm, Sweden

[73] Assignee: Extraversion, Inc., New York, N.Y.

[ * ] Notice: The portion of the term of this patent subsequent to Jul. 22, 2003 has been disclaimed.

[21] Appl. No.: 730,083

[22] Filed: May 3, 1985

Related U.S. Application Data

[63] Continuation of Ser. No. 397,514, Jul. 12, 1982, Pat. No. 4,601,524.

[51] Int. Cl.[4] ..... A47F 3/00

[52] U.S. Cl. ..... 312/114

[58] Field of Search ..... 248/174; 312/114, 140.2, 312/201, 258, 278, 325, 326, 327; 206/44 R; 190/3-7, 9, 11, 16

[56] References Cited

U.S. PATENT DOCUMENTS

| | | | |
|---|---|---|---|
| 2,046,627 | 7/1936 | Hill | 312/201 |
| 2,356,687 | 8/1941 | O'Reilly | 312/201 |
| 2,634,186 | 4/1953 | Zuss | 312/201 |
| 3,527,514 | 9/1970 | Jefferson | 312/244 |
| 3,794,399 | 2/1974 | Conner et al. | 312/244 |

*Primary Examiner*—Joseph Falk

*Attorney, Agent, or Firm*—Wolf, Greenfield & Sacks

[57] ABSTRACT

A display apparatus that is adapted to be used in a display position but may also be folded to a carrying position in which it is folded to a more compact arrangement. The display apparatus is in the form of a base housing having a front wall including a first display means which may be a rear projection display, and an upper housing overlying the base housing including a second display means. The upper housing preferably is formed in top and bottom housing sections. The top section is disposed over the bottom section in the display position so that the display is essentially in an upright position. In the folded position, the bottom section covers the top surface of the base housing while the top section extends to cover the first display means.

20 Claims, 6 Drawing Figures

DISPLAY DEVICE

This application is a continutation of application Ser. No. 397,514, filed July 12, 1982, now U.S. Pat. No. 4,601,524.

BACKGROUND OF THE INVENTION

The present invention relates in general to a display device or apparatus and pertains, more particularly to a display device that is readily portable and that is characterized by providing various types of visual display including by way of example, a fixed poster-type display in combination with a fixed or moving projection display.

One object of the present invention is to provide an improved display device or apparatus particularly one that is readily portable and that can be constructed relatively light in weight and yet provide a maximum amount of display surface.

Another object of the present invention is to provide an improved display apparatus which has an open display position and also a closed carrying position.

A further object of the present invention is to provide an improved display apparatus that provides for multiple types of display including by way of example, a fixed poster-type display along with a rear projection display.

Still another object of the present invention is to provide an improved display apparatus which has an open display position in which the display apparatus stands substantially upright, and a closed folded position in which the display is folded to a much more compact position more readily adapted for portability.

SUMMARY OF THE INVENTION

In accordance with the invention, there is provided a display apparatus which comprises a base housing and an upper housing overlying the base housing. The base housing has a front wall including a first display means while the upper housing includes a second display means. The upper housing is secured to a rear end of a top surface of the base housing. The upper housing is adapted to have both a display position and a folded position best for carrying the apparatus. In the display position the upper housing has its display means directed forwardly. This may also be referred to as an upright position for the display. In the folded position of the upper housing at least part thereof is folded over to cover the top surface of the base housing. In a preferred embodiment the upper housing has top and bottom section in the display position. In the folded position the bottom section covers the top surface of the base housing while the top section extends to cover the first display means. In the illustrated embodiment the first display means may be a rear projection camera or projector while the second display means may be a fixed display such as one illustrating pictures in a poster form. With regard to the interconnection between the base and hinge means permitting forward folding of the upper housing. Also, the top section of the upper housing is preferably hinged from the bottom section thereof with the hinge line extending along the edge formed between the top surface and front surface of the base housing. The top section of the upper housing also preferably has a right angle cross section with a portion thereof extending horizontally in the display position of the apparatus. One or more light sources are preferably provided in the upper housing for illuminating the second display means. In addition to the aforementioned display means, the apparatus may also comprise the sound equipment, including for example, a speaker or other audio device.

BRIEF DESCRIPTION OF THE DRAWINGS

Numerous other objects, features and advantages of the invention should become apparent upon a reading of the following detailed description taken in conjunction with the accompanying drawing, in which.

DETAILED DESCRIPTION

Figure 1:
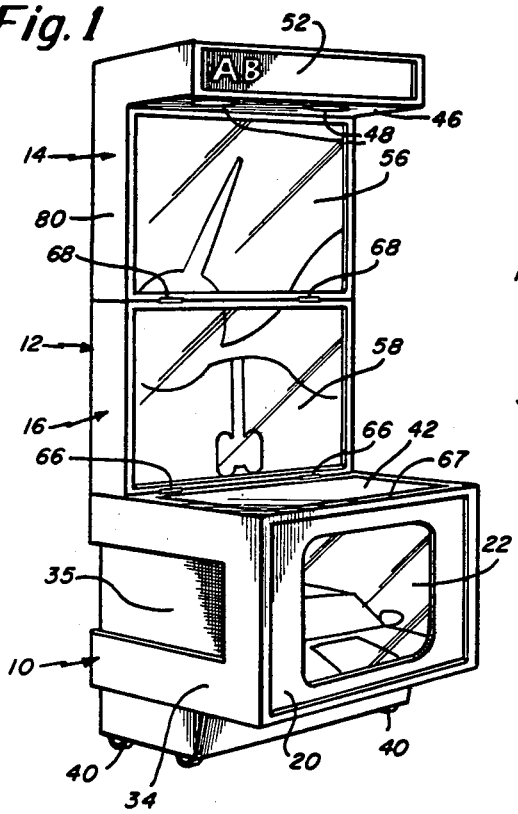
FIG. 1 is a perspective view of the display of the present invention in its usable display position.
Figure 2:
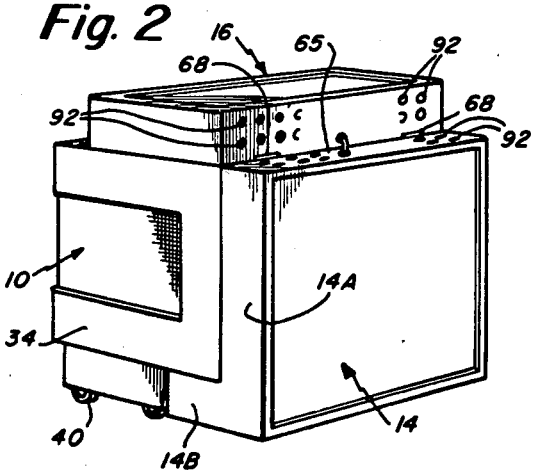
FIG. 2 is a perspective view of the same display as illustrated in FIG. 1 in its folded carrying position.

Referring now to the drawing, there is shown in FIG. 1 a display apparatus in accordance with the present invention in its upright display position. FIG. 2 illustrates the same display folded to its folded position for carrying. Generally speaking, the display comprises a base housing 10 and an upper housing 12 which is, in turn, separated into a top housing section 14 and a bottom housing section 16. The details of these housings and housing sections are described in more detail hereinafter particularly in the detailed cross sectional views of FIGS. 4 and 5.

Figure 3:
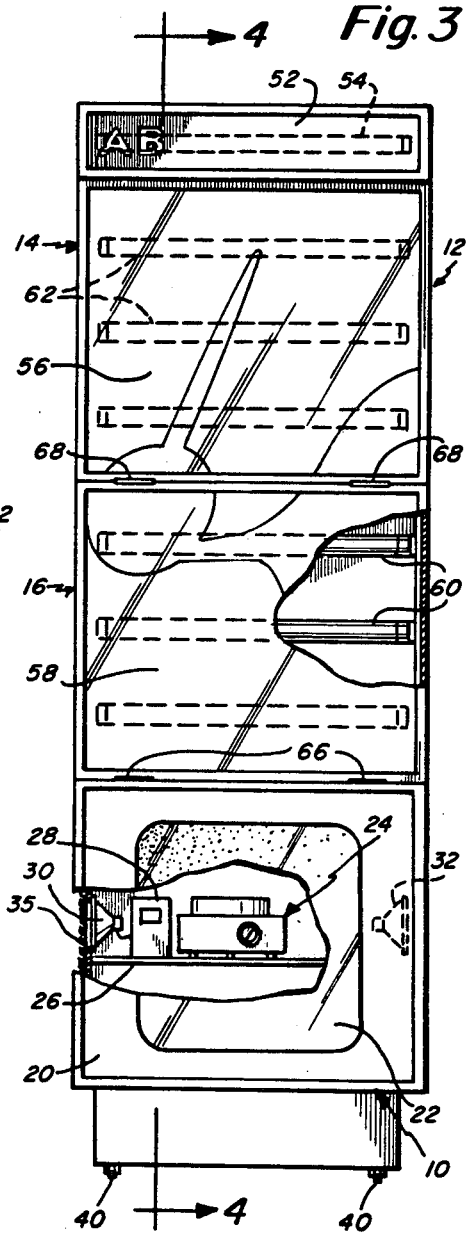
FIG. 3 is a front view partially cut away of the display apparatus of FIG. 1.
Figure 4:
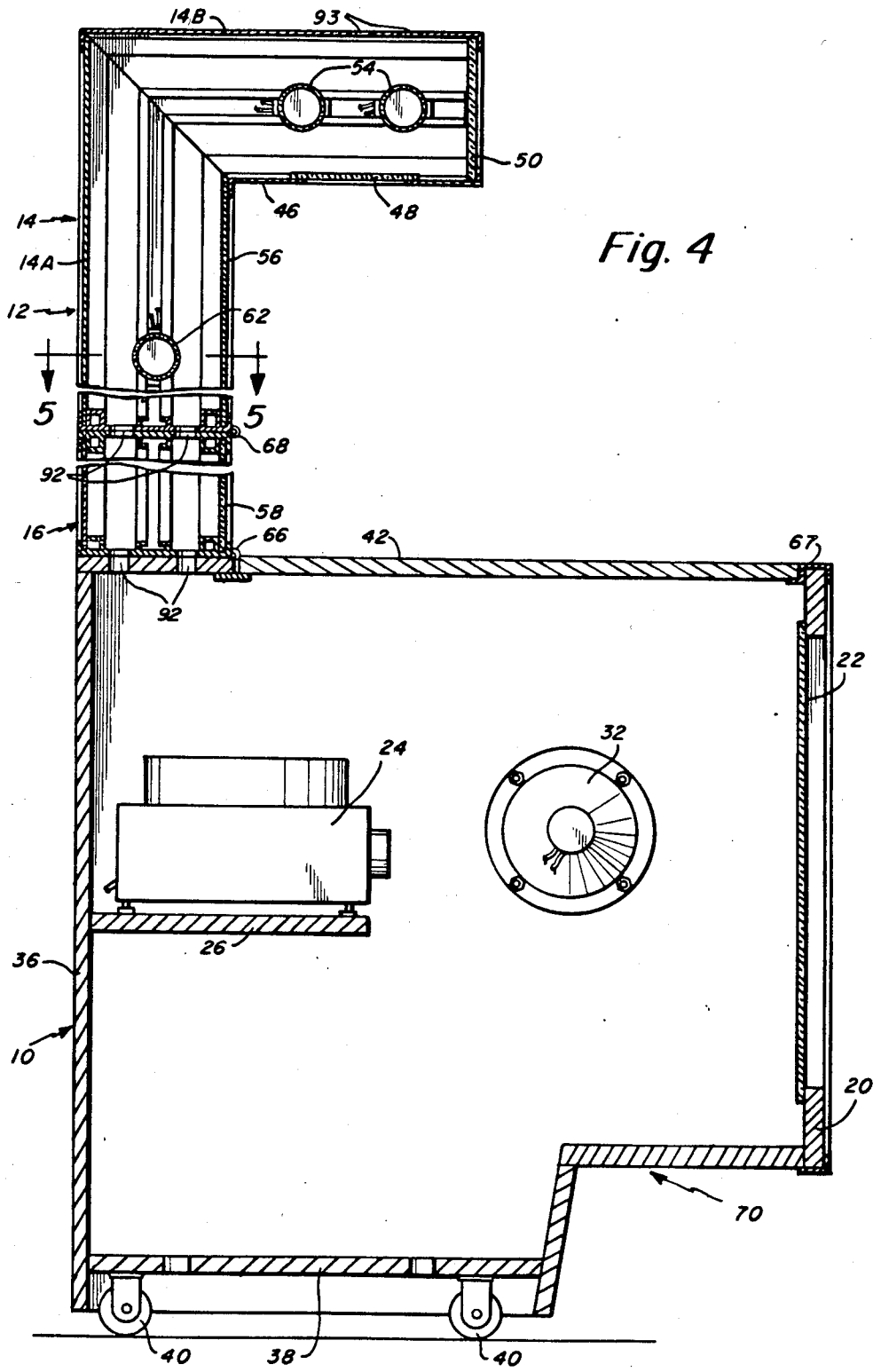
FIG. 4 is a cross sectional view through the display as taken along line 4—4 of FIG. 3.

The base housing 10 has a front wall 20 with an opening in which is supported a rear projection screen 22. The detailed cross sectional view of FIG. 4 shows the screen 22 and associated slide projector 24. Projector 24 may be of conventional design and is preferably supported on a horizontal support shelf 26. As illustrated in FIG. 3, the shelf 26, in addition to supporting the projector 24, may also provide support for the sound equipment box 28. The speakers 30 and 32 couple from the box 28.

The base housing 10, in addition to including the front wall 20, also includes side walls, such as the side wall 34 illustrated in FIG. 1, a rear wall 36, and a bottom wall 38. Preferably four casters 40 are secured to the bottom wall 38. These casters or rollers are used for supporting the display apparatus and enable at least limited rolling thereof. The shelf 26 is suitably supported from the rear wall 36. As clearly indicated in FIG. 4, the base housing 10 is substantially hollow leaving sufficient room therein for such equipment as the projector 24. The projector 24 may be operated from the outside of the display by suitable push buttom controls. Also, the rear wall 36 may be provided with one or more openings for permitting access to the slide projector 24. This access is preferable so as to enable the changing of the slides in the slide projector.

The side walls such as the wall 34 depicted in FIGS. 1 and 2 preferably has a sound transparent panel 35. The panel 35 has a speaker such as the speaker 30 suitably mounted just behind it. The panel 35 provides a pleasing aesthetic appearance but permits sound to travel there-through from the speaker 30 to outside of the display apparatus.

The base housing 10 also includes a top wall 42. The wall 42 may be fixed in position but is preferably as illustrated in FIG. 4, being removable. This simply lifts off of supporting members as illustrated in FIG. 4 so as to provide additional access to the slide projector 24 or any other apparatus within the base housing.

The display apparatus of this invention, in addition to including the base housing 10, also includes the upper housing which is sectioned into top and bottom housing sections 14 and 16, respectively. Each of these housing sections may be constructed of a light weight material such as plastic or aluminum. The section 16 is shown in its upright position in FIG. 1 and is shown in FIG. 2 folded to its flat position substantially covering the top panel 42 of the housing 10. The upper housing section 14, as illustrated in FIGS. 1 and 4 includes a vertical housing section 14A and an horizontal housing section 14B. Section 14B has a bottom wall 46 with one or more openings 47 for receiving transparent members 48. The section 14B also has a front wall 50 upon which a message may appear such as the message 52 illustrated in FIG. 1. FIG. 4 shows a pair of fluorescent lamps 54 disposed within the section 14B. These lamps provide suitable light output so as to provide illumination of the message 52 and also to shine light through the transparent members 48 downwardly onto the display apparatus.

The section 14A of the display apparatus includes a front message panel 56. Similarly, the forwardly facing side of the lower housing section 16 supports a message panel 58. These panels 56 and 58, as illustrated in FIG. 1 may contain contiguous messages.

FIG. 3 also illustrates the message panels 56 and 58. Also, in FIG. 3 a portion of the panel 58 s cut away to show fluorescent lamps or tubes 60 within the section 16. The section 14A also similarly has three fluorescent tubes or lamps 62 spacedly supported therein. The series of fluorescent lamps provide lighting for the display panels 56 and 58 from the rear thereof. This provides for a very effective displaying of the images or other text upon each of the panels 56 and 58.

As I have indicated previously, FIG. 1 shows the display of this invention in its upright display position. FIG. 2 illustrates the display in its folded position. To provide this folding the display has two pairs of hinges including a lower pair 66 and an upper pair 68. The lower pair 66 for hinging the bottom housing section 16 from the base housing 10. The other pair of hinges 68 are for hinging between the upper and lower housing sections 14 and 16, respectively. The height of the housing section 16 is made to be equal to the depth of the flat work surface defined by the top plate 42. In this way the hinge line 65 defined by the hinges 68 coincide with the edge 67 which is a front edge of the base housing 10. Moreover, it is noted that the base housing 10 is provided with a lower cutout space 70 which, as indicated in FIG. 2, receives a portion of the horizontal section 14B. In this regard as also indicated in FIG.2, it is noted that the height of the section 14A is made comparable to the height of the front wall 20 of the base housing 10. With these dimensions then the display is readily folded into a very compact arrangement as illustrated in FIG. 2. An appropriate locking means or the like may be used to secure the display in the position shown in FIG. 2. Also, some type of a handle could be added to the rear surface of the housing section 16 so that the entire display may be picked up or easily rolled.

Figure 5:
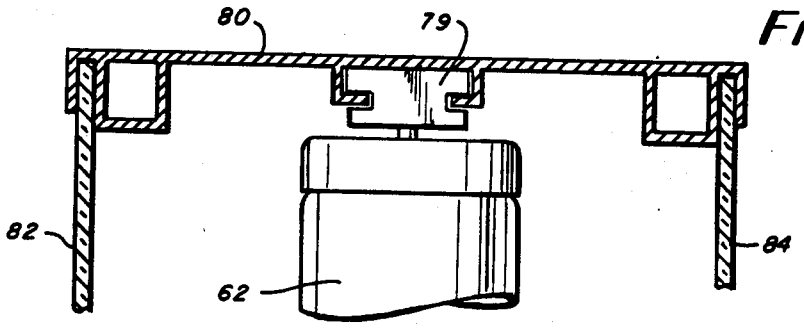
FIG. 5 is another cross sectional view through the display taken along line 5—5 of FIG. 4.

FIG. 5 is a cross sectional view taken along line 5—5 of FIG. 4 and showing further details of the upper housing section 14. This cross sectional view is taken at one of the fluorescent lamps 62. FIG. 5 shows one end of the lamp 62 supported within a contact 79 which in turn is supported from a side extrusion 80. The extrusion has end channels that support panels 82 and 84. One of these panels may also be the aforementioned display panels 56 or 58.

Figure 6:
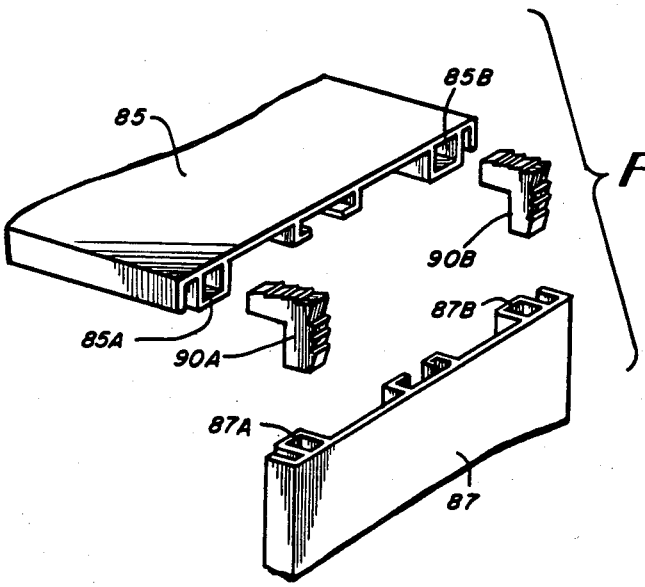
FIG. 6 is a fragmentary exploded perspective view showing an interconnection technique for portions of the display.

FIG. 6 shows the construction that might be used at a right angle corner between the side extrusions which define one of the housing sections such as either section 14 or section 16. Thus, in FIG. 6 there are shown right angled extrusions 85 and 87. The extrusion 85 has a pair of square shaped holes 85A and 85B. Similarly the extrusion 87 has square shaped holes 87A and 87B. Right angled interlocking members 90A and 90B interlock with the different square shaped holes in the manner illustrated in FIG. 6 so as to tie together the extrusions at a right angle at interconnecting corners.

As illustrated in FIGS. 2 and 4, and because of the heat generated from the fluorescent lamps, venting is provided between the different housings comprising the display. FIGS. 2 and 4 show the vent holes 92 which provide for the free flow of air between the different housing sections to provide sufficient cooling. In addition, a fan may be provided within the base housing to circulate air. It is also noted that at the very top of the display as illustrated in FIG. 4 there are also provided vent holes 93. This arrangement of venting provides free flowing air through the entire display from top to bottom particularly when in use in the position shown in FIG. 1.

Having described one embodiment of the present invention, it should now be apparent to those skilled in the art that numerous other embodiments are contemplated as falling within the scope of this invention.

What is claimed is:

1. A display apparatus comprising;

a base housing having a front wall including a first display means, an upper housing overlying the base housing and including a second display means, means hingedly securing the upper housing to a rear end of a top surface of the base housing along a base hinge line, said upper housing having a display position in which said second display means is directed forwardly and in which the upper housing is in an upright position, and a storage position in which at least part of the upper housing is disposed to extend over the top surface of the base housing, said upper housing having top and bottom housing sections wherein the top section is disposed over the bottom section in the display position, and in the storage position the bottom section is disposed over the top surface of the base housing while the top section extends to cover the first display means, means for hingedly securing the upper housing top housing section to the upper housing bottom housing section, said bottom and at least part of said top housing sections, in said display position, adapted to be disposed in substantially co-planar vertical position, said the top section of the upper housing being hinged from the bottom sections with the hinge line disposed, in the storage position, adjacent the edge formed between the top surface and front surface of the base housing.

2. A display apparatus as set forth in claim 1 including a light source in said upper housing for illuminating the second display means.

3. A display apparatus as set forth in claim 2 wherein said second display means comprises a fixed poster display.

4. A display apparatus as set forth in claim 1 wherein said first display means comprises a rear projection screen in combination with a projector disposed within said base housing.

5. A display apparatus comprising;

a base housing having a front wall including a first display means comprising a rear projection screen in combination with a projector disposed within said base housing at a position remote from said rear projection screen, said base housing further comprising a substantially flat top wall extending over substantially the entire top of the base housing and access means into the base housing, a hollow upper housing overlying the base housing and including a second display means comprising a fixed poster display panel and means in the hollow upper housing for illuminating the fixed poster display panel from the rear thereof, means hingedly securing the upper housing to a rear end of a top surface of the base housing, said upper housing having a display position in which said fixed poster display is directed forwardly and in which the upper housing is in an upright position, and a storage position in which at least part of the upper housing is disposed to extend over the top surface of the base housing.

6. A display apparatus as set forth in claim 5 wherein said upper housing has top and bottom housing sections with the top section disposed over the bottom section in the display position and in the storage position the bottom section covers the top surface of the base housing while the top section extends to cover the rear projection screen.

7. A display apparatus as set forth in claim 6 wherein the means securing the upper housing to the base housing comprises hinge means permitting forward folding of the upper housing.

8. A display apparatus as set forth in claim 5 wherein, in the storeage position of the display, the fixed poster display panel rests directly on the substantially flat top wall of the base housing.

9. A display apparatus as set forth in claim 5 wherein, said means hingedly securing includes at least one hinge extending along a hinge line forward of the rear wall of the base housing at the top surface of the base housing whereby the base of the upper housing rests upon the base housing at the rear end of the base housing at the rear end of the base housing top surface.

10. A display apparatus as set forth in claim 9 wherein the hinge line is forwward of the rear wall by a dimension on the order of the depth of the upper housing.

11. A display apparatus as set forth in claim 10 wherein said means hingedly securing includes a pair of spaced hinges.

12. A display apparatus as set forth in claim 9 wherein said upper housing has top and bottom housing sections with the top section disposed over the bottom section in the display position and in the storage position the bottom section covers the top surface of the base housing while the top section extends to cover the rear projection screen.

13. A display apparatus as set forth in claim 12 wherein the means securing the upper housing to the base housing comprises hinge means permitting forward folding of the upper housing.

14. A display apparatus as set forth in claim 13 wherein the top section of the upper housing is hinged from the bottom section with the hinge line extending along the edge formed between the top surface and front surface of the base housing in the storage position.

15. A display apparatus as set forth in claim 14 wherein said top section of the upper housing has a right angle cross-section with a portion thereof extending horizontally in the display position.

16. A display apparatus a base housing having a front wall including a first display means comprising a rear projection screen in combination with a projector disposed within said base housing at a position remote from said rear projection screen, said base housing further comprising a substantially flat top wall extending over substantially the entire top of the base housing and access means into the base housing, an upper housing overlying the base housing and including a second display means comprising a fixed poster display and means in the upper housing for illuminating the fixed poster display, means securing the upper housing to a rear end of a top surface of the base housing, said upper housing having a display position in which said fixed poster display is directed forwardly and in which the upper housing an upright position, and a storage position in which at least part of the upper housing is disposed to extend over the top surface of the base housing, wherein said upper housing has top and bottom housing sections with the top section disposed over the bottom section in the display position and in the storage position the bottom section covers the top surface of the base housing while the top section extends to cover the rear projection screen, wherein the means securing the upper housing to the base housing comprises hinge means permitting forward folding of the upper housing, wherein the top section of the upper housing is hinged from the bottom section with the hinge line extending along the edge formed between the top surface and front surface of the base housing in the storage position.

17. A display apparatus as set forth in claim 16 wherein said top section of the upper housing has a right angle cross-section with a portion thereof extending horizontally in the display position.

18. A display apparatus comprising;

a base housing having a front wall including a first display means, an upper housing overlying the base housing and including a second display means, means securing the upper housing to a rear end of a top surface of the base housing, said upper housing having a display position in which said second display means is directed forwardly and in which the upper housing is in an upright position, and a storage position.

said upper housing having top and bottom housing sections, wherein the top section is disposed over the bottom section in the display position, and in a storage position, at least the bottom section is disposed over the top surface of the base housing, said top and bottom housing sections each having respective fixed poster display means and means for illuminating the fixed poster display means, said top housing section having a right angle cross-section with a portion thereof extending horizontally in the display position, said top section of the upper housing extending at least in part under the base housing, at the front side thereof, in the storage position of the display apparatus.

19. A display apparatus comprising;

a base housing having a front wall including a first display means comprising a rear projection screen in combination with a projector disposed within said base housing at a position remote from said rear protection screen, an upper housing overlying the base housing and including a second display means comprising a display and means in the upper housing for illuminating the display, means securing the upper housing to a rear end of a top surface of the base housing, said upper housing having a display position in which said dispaly is directed forwardly and in which the upper housing is in an upright position, and a storage position in which at least part of the upper housing is disposed to extend over the top surface of the base housing, said upper housing having top and bottom housing sections witht he top section disposed over the bottom section in the display position, and in the storage position, the bottom section covers the top surface of the base housing while the top section extends to cover the rear projection screen, and means for hingedly securing the upper housing top housing section to the upper housing bottom housing section.

20. A display apparatus comprising;

a base housing having a front wall including a first display means, an upper housing overlying the base housing and including a second display means, means hingedly securing the upper housing to a rear end of a top surface of the base housing along a base hinge line, said upper housing having a display position in which said second display means is directed forwardly and in which the upper housing is in an upright position, and a storage position in which at least part of the upper housing is dipsosed to extend over the top surface of the base housing, said upper housing having top and bottom housing section wherein the height of said bottom section is at least equal to the distance between said base hinge line and said front wall of the base housing, wherein the top section is disposed over the bottom section in the display position and in the storage position the bottom section is disposed over the top surface of the base housing while the top section extends to cover the first display means, means for hingedly securing the upper housing top housing section to the upper housing bottom housing section along an upper hinge line, said bottom and at least part of said top housing sections, in said display position, adapted to be disposed in substanially parallel co-planar vertical position, wherein the upper hinge line in said storage position extends along the edge formed between the top surface and front surface of the base housing.

* * * * *